United States Patent [19]

Rassias

[11] 4,295,313

[45] Oct. 20, 1981

[54] BUILDING BLOCKS, WALL STRUCTURES MADE THEREFROM AND METHODS OF MAKING THE SAME

[76] Inventor: John N. Rassias, c/o Intralock Systems International Corporation, 565 Park Ave., New York, N.Y. 10021

[21] Appl. No.: 102,251

[22] Filed: Dec. 10, 1979

[51] Int. Cl.[3] ..... E04B 2/68

[52] U.S. Cl. ..... 52/438; 52/436; 52/437; 52/439; 52/592

[58] Field of Search ..... 52/438, 437, 436, 439, 52/592

[56] References Cited

U.S. PATENT DOCUMENTS

| | | | |
|---|---|---|---|
| 989,344 | 4/1911 | Forbes . | |
| 1,154,546 | 9/1915 | Peters | 52/438 |
| 1,351,471 | 8/1920 | Drabers | 52/436 |
| 1,410,588 | 3/1922 | Myers | 52/439 X |
| 1,588,332 | 6/1926 | Peters | 52/436 |
| 1,974,564 | 9/1934 | Donovan | 52/437 X |
| 2,634,602 | 4/1953 | Zagray . | |
| 2,696,102 | 12/1954 | Zagray . | |
| 2,749,739 | 6/1956 | Zagray . | |
| 2,811,035 | 10/1957 | Zagray . | |
| 3,382,632 | 5/1968 | Grofcsik . | |
| 3,534,518 | 10/1970 | Zagray . | |
| 3,534,518 | 10/1970 | Zagray | 52/436 |
| 3,968,615 | 7/1976 | Ivany . | |

FOREIGN PATENT DOCUMENTS

| | | | |
|---|---|---|---|
| 599709 | 10/1925 | France | 52/436 |
| 770832 | 7/1934 | France | 52/439 |
| 129494 | 12/1928 | Switzerland | 52/439 |

*Primary Examiner*—Alfred C. Perham

*Attorney, Agent, or Firm*—Buell, Blenko, Ziesenheim & Beck

[57] ABSTRACT

A building block and masonry wall constructed therefrom are provided wherein the building block has a pair of spaced opposite generally parallel side walls, spaced top and bottom faces and a pair of end spaces, a pair of spaced apart ribs on said top face, a pair of mating recesses on said bottom face, an intermediate generally centrally extending horizontal groove in each of the top and bottom faces, a pair of narrower grooves, one on either side of said centrally extending groove on each of said top and bottom faces, a pair of spaced ribs on one end, a pair of mating grooves on the other end, an intermediate vertical passage in said block corresponding in width to the widest portion of the central grooves on said top and bottom faces, a pair of vertical passages on each side of said intermediate vertical passage connecting the pair of top and bottom narrower grooves, and a vertical recess in each end intermediate the side walls and having a cross section substantially equal to one half of said intermediate vertical passage.

10 Claims, 5 Drawing Figures

BUILDING BLOCKS, WALL STRUCTURES MADE THEREFROM AND METHODS OF MAKING THE SAME

This invention relates to building blocks, wall structures made therefrom and methods of making the same and particularly to a building block and wall which is laid up without mortar in the joints in the manner of a dry wall and provided with openings capable of receiving metal reinforcing bars in both the vertical and horizontal directions surrounded by grout pumped or poured into said openings to surround the metal reinforcing to form a rigid wall of superior strength and of high insulating quality and free from external mortar joints.

It is known to provide building blocks which are laid up in the manner of a dry wall and which are held in place by an inner network of cement grout poured into interconnecting passages in the block. Typical of such prior art blocks are those provided in Zagray U.S. Pat. Nos. 2,696,102, 2,811,035, 2,634,602, and 2,749,739 and Grofcsik U.S. Pat. No. 3,382,632. These patents do not permit the successful inclusion of continuous reinforcing bars from top to bottom of the wall and from end to end. As a result, the wall built from such blocks is subject to cracking and separation as a result of many factors just as is an unreinforced concrete wall. Repeated attempts have been made to insert reinforcing bars in such walls without success because of the voids which are formed, particularly at the intersection of horizontal and vertical reinforcing bars. All attempts, prior to this invention, to avoid this problem have been unsuccessful. As a result, the system of wall construction exemplified by the Zagray and similar patents has met with very limited success and is not approved in many areas.

I have invented a block and wall system and method of installation which overcomes these problems and makes it possible to install both vertical and horizontal reinforcing metal bars along with concrete or mortar grout without the danger of incorporating impermissible voids in the final grout network, which has been the great problem with prior art structures. As a result, the block and wall of this invention are the first which will pass the structural codes of all areas known to me and yet will provide the necessary insulating factor.

I provide a substantially rectangular masonry building block having a pair of spaced opposite generally parallel sides, spaced top and bottom faces and a pair of spaced end faces, a pair of spaced apart ribs on said top face, a pair of mating recesses on said bottom face, an intermediate generally centrally extending horizontal groove in the bottom face and a corresponding mating groove in the top face and a pair of smaller horizontal grooves on the top face, one on each side of the intermediate groove between the ribs and intermediate groove and a pair of corresponding mating smaller grooves in the bottom face between the intermediate groove and the mating recesses, a pair of spaced ribs on one end, a pair of spaced mating recesses on the opposite end, an intermediate vertical passage in said block corresponding in width to the central groove and a like vertical recess intermediate the ribs at said one end and the said recess and a pair of vertical passages on each side of said intermediate vertical passage connecting the pair of top and bottom smaller grooves. Preferably, the intermediate vertical groove extends over about substantially one third of the length of the block and the vertical recess at each end extend over a like distance. Each of the pair of vertical passages on each side similarly extends over about one third of the length of the block. The vertical passages provide space for vertical and horizontal reinforcing rods and for vertical and horizontal piping or conduit. The central grooves and passages are filled with grout around the reinforcing bars and pipe placed thereon. The outside grooves and passages are preferably filled with grout and with reinforcing bars extending in one direction, preferably vertical.

In the foregoing general description of my invention, I have set out certain objects, purposes and advantages of this invention. Other objects, purposes and advantages of the invention will be apparent from a consideration of the following description and the accompanying drawings in which.

Figure 1:
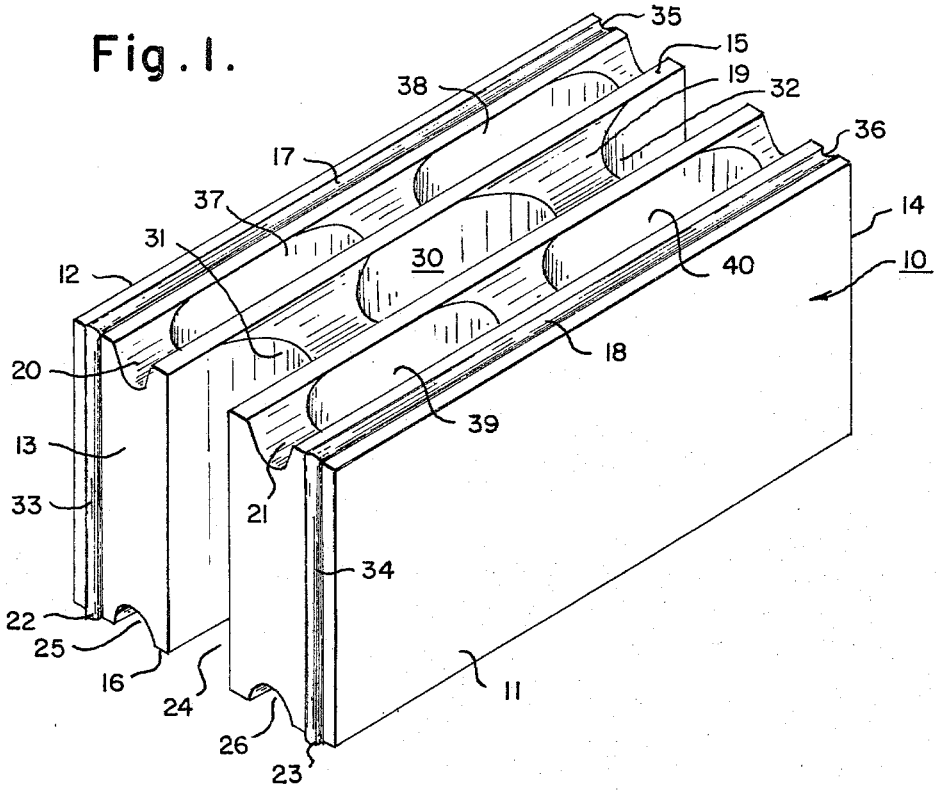
FIG. 1 is an isometric view of a preferred embodiment of block according to my invention.

Referring to the drawings I have illustrated a block 10 having parallel spaced apart side walls 11 and 12, end walls 13 and 14, a top face 15 and a bottom face 16. The top face 15 is provided with a pair of parallel ribs 17 and 18 extending above the surface thereof spaced inwardly from the side walls 11 and 12, a central longitudinally extending groove 19 intermediate ribs 17 and 18, a pair of smaller grooves 20 and 21, one on each side of groove 19 between groove 19 and ribs 17 and 18. The bottom face 16 is provided with grooves 22 and 23 which are the reverse of ribs 17 and 18 and are adapted to matingly receive ribs 17 and 18 of the next succeeding lower block. Face 16 also has grooves 24, 25 and 26 which mate with grooves 19, 20 and 21, respectfully, to form generally circular or ovoid horizontal passages 27, 28 and 29 between successive blocks. A central vertical passage 30 extending over substantially the length of the block and corresponding in width to central grooves 19 and 24 connects grooves 19 and 24. Recesses 31 and 32 corresponding generally to substantially one half of passage 30 extend vertically on end walls 13 and 14 between central grooves 19 and 24 so that when recess 31 of one block mates with recess 32 of a next adjacent block, a vertical passage is formed between the two which is substantially identical to passage 30. End wall 13 has a pair of parallel ribs 33 and 34 extending vertically, one on either side of recess 31 and in line with ribs 17 and 18 and grooves 22 and 23 on the bottom face. The other end wall 14 has mating grooves 35 and 36 adapted to receive ribs 33 and 34 of a next adjacent block. There are also provided a pair of vertical spaced passages 37 and 38 connecting grooves 20 and 25 and a pair of vertical spaced passages 39 and 40 connecting grooves 21 and 26. Each of these passages extends about one third of the length of the block and are spaced so that their centers lie between vertical passage 30 and either recess 31 or 32.

Figure 2:
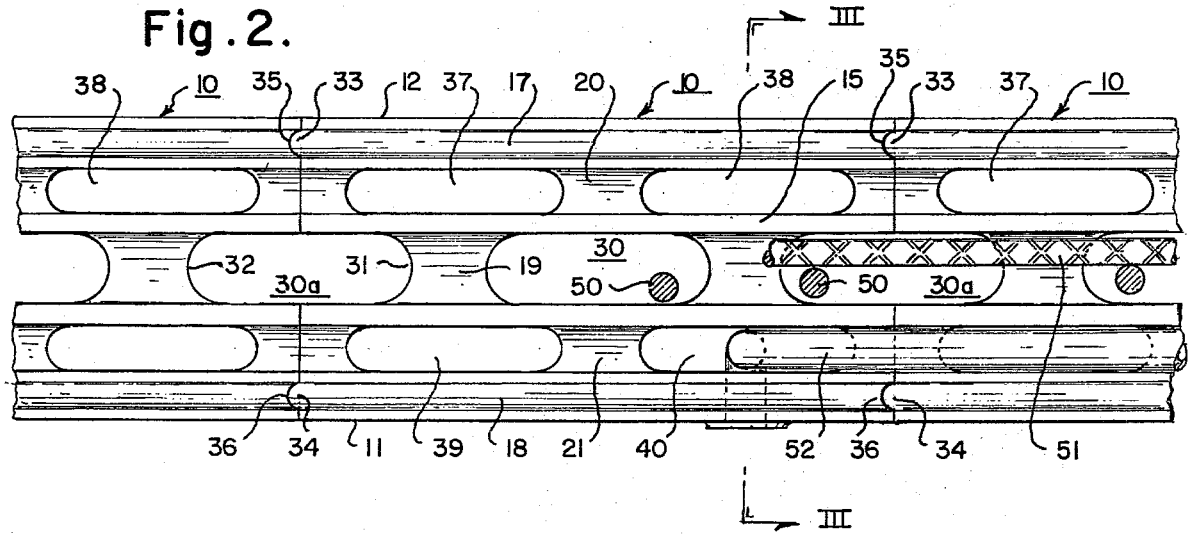
FIG. 2 is a horizontal section through a wall made of the blocks of FIG. 1.
Figure 3:
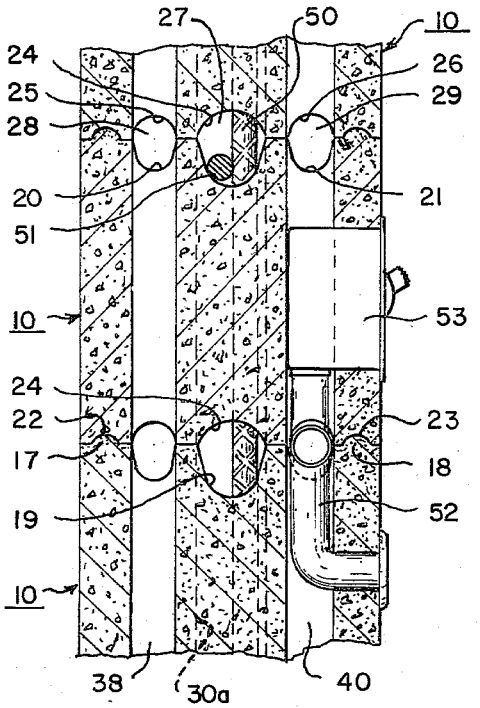
FIG. 3 is a vertical section on the line III—III of FIG. 2.

In FIGS. 2 and 3 I have illustrated a wall structure incorporating the block of FIG. 1. The blocks 10 are laid up dry, preferably with their vertical joints broken so that there is no vertical line of joints in the wall; however, this is not a limiting factor. Metal reinforcing bars 50 are placed vertically through central passage 30 and the passage 30*a* formed by recesses 31 and 32 and horizontally 51 through the ovoid passage 27 formed by grooves 19 and 24 except where a large diameter service pipe such as a drain 52 is placed in the vertical passage 30 and the passage 30*a* formed by recesses 31 and 32. Liquid cement grout is then pumped through passages 30, 30*a* and 27 to form a network of cement grout through the core of the wall. In addition, reinforcing bars may be placed either horizontally through ovoid passage 28 formed by grooves 20 and 25 or vertically through passages 37 and 38 and liquid cement grout pumped through passages 28 and 37 and 38 to form a second network of cement grout and rebars where additional strength is desired. Passages 39 and 40 and passage 29 formed by grooves 21 and 23 on the inside of the wall are left open to provide insulating quality to the wall and to provide passages for smaller piping and conduit for services such as gas, water, telephone and electricity. Such a water service line is illustrated at 52 and an electrical service outlet at 53 in FIGS. 2 and 3.

Figure 4:
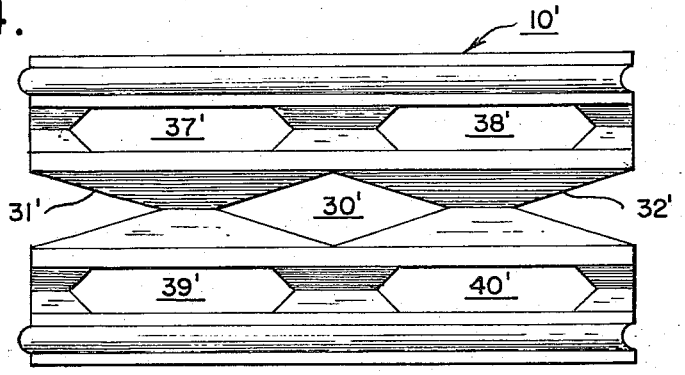
FIG. 4 is a top plan view of a second embodiment of block according to my invention.
Figure 5:
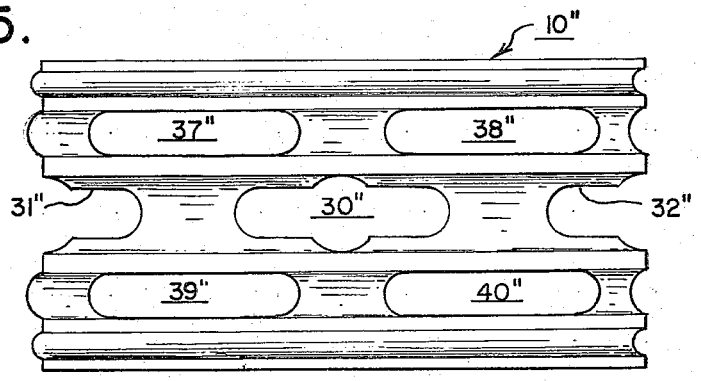
FIG. 5 is a top plan view of a third embodiment of block according to my invention.

In FIGS. 4 and 5 I have illustrated two additional embodiments of my invention which differ only in that in FIG. 4 the central passage 30' and recesses 31' and 32' are diamond shaped rather than elliptical in shape as are also passages 37' and 38' and 39' and 40'. In assembly in a wall they operate precisely as does the the block of FIG. 1. In FIG. 5 the central passage 30" and recesses 31" and 32" are shaped so that vertical keyhole passages are provided. The same is true of passages 37" and 38" and 39" and 40".

The significant factor in passages 30, 30' and 30" and the passages formed by recesses 31, 32, 31', 32', 31" and 32" is that they have a portion which is sufficiently larger than the reinforcing bars used in the wall to permit the fluid cement grout to be pumped around the intersection between vertical and horizontal reinforcing bars without reducing the size of the rebars to the point where they are of little value. In addition, the block of this invention provides for a secondary rebar and grout network in passages 20*a* and 37 and 38 while providing insulating and service conduit passages within the wall through passages 39, 40 and 21*a*.

No prior art building block or masonry wall incorporating the same known to me provides these unique features which make it possible to provide both the high strength and rigidity required to meet existing building codes together with the flexibility to handle services, piping and conduit within the wall itself.

In the foregoing specification I have set out certain preferred embodiments and practices of my invention; however, it will be understood that this invention may be otherwise embodied within the scope of the following claims.

I claim:

1. A substantially rectangular masonry building block having a pair of spaced opposite generally parallel side walls, spaced top and bottom faces and a pair of spaced end faces, a pair of spaced apart ribs on said top face, one adjacent and spaced from each side wall, a pair of mating recesses on said bottom face, an intermediate generally centrally extending horizontal groove in each of the top and bottom faces, a pair of narrower grooves, one on either side of said centrally extending groove on each of said top and bottom faces and spaced from said ribs and mating recesses and from said intermediate groove, a pair of spaced ribs on one end face, a pair of mating grooves on the other end face, said ribs and grooves being aligned with the ribs and recesses on the top and bottom faces, an intermediate vertical passage in said block corresponding in width to the widest portion of the central grooves on said top and bottom faces, a pair of vertical passages on each side of said intermediate vertical passage connecting the pair of top and bottom narrower grooves, and a vertical recess in each end face intermediate the side walls and having a cross section substantially equal to one half of said intermediate vertical passage.

2. A building block as claimed in claim 1 wherein the intermediate vertical passage extends lengthwise of said block about 25% to 35% of the length thereof and about 25% to 35% the width of said block at the widest point of said passages.

3. A building block as claimed in claim 1 wherein each of the pair of vertical passages on each side of the central vertical passage extends lengthwise of said block about 25% to 35% of the block and about 15% to 25% of the width of said block at the widest point of said passages.

4. A building block as claimed in claim 2 wherein said length and width of the intermediate passage are about one third of the corresponding dimension of said block.

5. A building block as claimed in claim 3 wherein the length of each of said pair of vertical passages is about one third of the length of the block and the width of each at its widest point is about 20% of the width of the block.

6. A building block as claimed in claims 1 or 2 or 3 or 4 or 5 wherein the cross sectional shape of the vertical passages is oval.

7. A building block as claimed in claims 1 or 2 or 3 or 4 or 5 wherein the cross sectional shape of the vertical passages is an elongate diamond.

8. A building block as claimed in claims 1 or 2 or 3 or 4 or 5 wherein the cross sectional shape of the vertical passages is a double keyhole.

9. A masonry wall structure formed of superimposed courses of masonry building blocks, each block having a pair of spaced opposite generally parallel side walls, spaced top and bottom faces and a pair of spaced end faces, a pair of spaced apart ribs on said top face, one adjacent and spaced from each side wall, a pair of mating recesses on said bottom face, an intermediate generally centrally extending horizontal groove in each of the top and bottom faces, a pair of narrower grooves, one on either side of said centrally extending groove on each of said top and bottom faces and spaced from said ribs and mating recesses and from said intermediate groove, a pair of spaced ribs on one end face, a pair of mating grooves on the other end face, said ribs and grooves being aligned with the ribs and recesses on the top and bottom faces, an intermediate vertical passage in said block corresponding in width to the widest portion of the central grooves on said top and bottom faces, a pair of vertical passages on each side of said intermediate vertical passage connecting the pair of top and bottom narrower grooves, and a vertical recess in each end face intermediate the side walls and having a cross section substantially equal to one half of said intermediate vertical passage and said blocks being laid up in staggered adjacent superimposed courses with the ribs on the top and one end face engaging within the recesses on the bottom and the grooves on the other end face and the vertical passages in vertical alignment throughout the height of the wall and the mating top and bottom grooves forming continuous horizontal passages intersecting the vertical passages throughout the length of the wall, metal reinforcing bars in at least a major portion of the intermediate vertical passages and the passages formed by the horizontal mating intermediate grooves in the top and bottom faces and a network of solidified hydraulic cement grout filling said intermediate passages and around the reinforcing bars.

10. A masonry wall structure as claimed in claim 9 wherein a pair of vertical passages on one side of the central vertical passage and a corresponding horizontal passage formed by the mating smaller top and bottom grooves contains one of a vertical and horizontal reinforcing bar and are filled with solidified hydraulic cement grout forming a continuous secondary network generally parallel to the said network formed in the intermediate passages.

* * * * *